US009943154B2

(12) United States Patent
Teshima et al.

(10) Patent No.: US 9,943,154 B2
(45) Date of Patent: Apr. 17, 2018

(54) DRAWING APPARATUS AND DRAWING CONTROL METHOD OF DRAWING APPARATUS

(71) Applicant: CASIO COMPUTER CO., LTD., Shibuya-ku, Tokyo (JP)

(72) Inventors: Yoshihiro Teshima, Higashimurayama (JP); Kouichi Nakagome, Tokorozawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/421,990

(22) Filed: Feb. 1, 2017

(65) Prior Publication Data

US 2017/0215549 A1 Aug. 3, 2017

(30) Foreign Application Priority Data

Feb. 2, 2016 (JP) ..... 2016-017877

(51) Int. Cl.
*G06K 15/22* (2006.01)
*A45D 29/00* (2006.01)
*A45D 34/04* (2006.01)

(52) U.S. Cl.
CPC ..... *A45D 29/00* (2013.01); *A45D 34/04* (2013.01); *A45D 2029/005* (2013.01)

(58) Field of Classification Search
None
See application file for complete search history.

(56) References Cited

U.S. PATENT DOCUMENTS 6,286,517 B1 * 9/2001 Weber ..... A45D 29/00 132/200
6,336,694 B1 * 1/2002 Ishizaka ..... A45D 29/00 347/105
6,525,724 B1 * 2/2003 Takami ..... A45D 29/00 345/418
2012/0287192 A1 * 11/2012 Yamasaki ..... B41J 3/407 347/14
2013/0038648 A1 * 2/2013 Kasahara ..... B41J 3/407 347/2
2014/0267517 A1 * 9/2014 Yamasaki ..... B41J 3/4073 347/101

(Continued)

FOREIGN PATENT DOCUMENTS

JP 2000194838 A 7/2000

*Primary Examiner* — Ted Barnes
(74) *Attorney, Agent, or Firm* — Holtz, Holtz & Volek PC

(57) ABSTRACT

A drawing apparatus includes a drawing unit that forms a nail design on a nail of an object by performing a plurality of processes and a processor that extracts a feature value of the object and controls the drawing unit.
The processor acquires information on a performed process with respect to the nail of one object, whose nail is provided to be formed with the nail design, based on process management information in which the feature value with respect to each of a plurality of the objects and an information on the performed process with respect to the nail of each of the plurality of the objects are registered in association with each other and the feature value with respect to the one object, and determines a specific process to be performed to the nail of the one object, and causes the drawing unit to perform the specific process.

19 Claims, 5 Drawing Sheets

(56) References Cited

U.S. PATENT DOCUMENTS

| | | | | |
|---|---|---|---|---|
| 2015/0007841 | A1* | 1/2015 | Yamasaki | A45D 29/00 132/73.5 |
| 2015/0128981 | A1* | 5/2015 | Asako | A45D 29/00 132/200 |
| 2015/0138264 | A1* | 5/2015 | Yamasaki | B41J 3/407 347/9 |

* cited by examiner

FIG. 4

53

PROCESS MANAGEMENT INFORMATION

| IDENTIFYING NUMBER | PERFORMED PROCESSING | NAIL INFORMATION | IMAGE | FEATURE VALUE |
|---|---|---|---|---|
| 1 | TOPCOAT FORMING PROCESS | CURVATURE: x1<br>OUTLINE SHAPE: y1 | | FEATURE POINT 1: FEATURE VALUE 11<br>:<br>FEATURE POINT N: FEATURE VALUE 1N |
| 2 | DESIGN DRAWING FORMING PROCESS | CURVATURE: x2<br>OUTLINE SHAPE: y2 | | FEATURE POINT 1: FEATURE VALUE 21<br>:<br>FEATURE POINT N: FEATURE VALUE 2N |
| 3 | FOUNDATION FORMING PROCESS | CURVATURE: x3<br>OUTLINE SHAPE: y3 | | FEATURE POINT 1: FEATURE VALUE 31<br>:<br>FEATURE POINT N: FEATURE VALUE 3N |
| ⋮ | ⋮ | ⋮ | ⋮ | ⋮ |
| 10 | NOT PERFORMED | CURVATURE:<br>OUTLINE SHAPE: | | FEATURE POINT 1:<br>FEATURE POINT N: |

DRAWING APPARATUS AND DRAWING CONTROL METHOD OF DRAWING APPARATUS

CROSS-REFERENCE TO RELATED APPLICATIONS

This application claims priority to Japanese Patent Application No. 2016-017877 filed on Feb. 2, 2016, the entire contents of which are incorporated by reference herein.

BACKGROUND OF THE INVENTION

1. Field of the Invention

The present invention relates to a drawing apparatus and a drawing control method of the drawing apparatus.

2. Description of the Related Art

A drawing apparatus that includes a holder for locking a finger and draws a nail design on a nail of the finger locked by the holder has been known. This type of drawing apparatus is described in, for example, JP 2000-194838 A.

In order to form a beautiful nail design on a nail, a plurality of processes is required, such as a process of forming a foundation on the nail, a process of forming a design drawing on the formed foundation, and a process of forming a topcoat on the formed design drawing.

In this case, the process of forming the design drawing cannot be performed with respect to the nail of one finger until ink coated in order to form the foundation dries. Furthermore, the process of forming the topcoat cannot be performed until the ink coated in order to form the design drawing dries.

Therefore, in a case where a series of the processes of from the formation of the foundation to the formation of the topcoat, is performed with respect to the nail of the one finger, waiting for the dry of the ink coated in a previous process, is required during the respective processes. Accordingly, it takes time to finish performing the nail design to the nails of all fingers.

Meanwhile, processing with respect to the nail of another finger in the fingers is performed during a period during which the dry of the ink coated in the previous process is completed during the above respective processes. Thus, the time necessary to form the nail design on the nails of all the fingers, can shorten.

Note that, a start is required from a midway process for the nail of each of the fingers in order to achieve the shortening. Thus, performing process management of ascertaining which process has been completed and which process is next performed to each of the nails of the plurality of fingers, is required.

However, in a case where the process management is entrusted to a user, a burden of the user increases and additionally the process to be performed to the nail of each of the fingers is wrongly selected so that failure in the formation of the nail design may occurs.

BRIEF SUMMARY OF THE INVENTION

A drawing apparatus and a drawing control method of the drawing apparatus according to embodiments of the present invention, have an advantage that time necessary to perform a nail design can shorten and additionally no user is burdened with process management.

In order to achieve the above advantage, the drawing apparatus according to one of the embodiments of the present invention, includes: a drawing unit configured to form a nail design on a nail of an object by performing a plurality of processes, the object being a finger or a toe having the nail; and a processor configured to extract a feature value of the object based on a captured image of the object and configured to control the drawing unit. The feature value with respect to each of a plurality of the objects different from each other and information on a performed process with respect to the nail of each of the plurality of the objects are registered in association with each other in a storing unit as process management information. The processor determines whether an one object, whose nail is provided to be formed with the nail design, is one of the plurality of the objects based on the process management information and a feature value of the one object, acquires information on a performed process with respect to the nail of the one object based on the process management information in a case where the processor determines that the one object is a specific object of the plurality of the objects, determines a specific process of the plurality of processes to be performed with respect to the nail of the one object based on the acquired information on the performed process, and controls the drawing unit to perform the specific process.

In the drawing control method of the drawing apparatus according to one of the embodiments of the present invention in order to achieve the above advantage, the drawing apparatus includes: a drawing unit configured to form a nail design on the nail of an object by performing a plurality of processes, the object being a finger or a toe having the nail, and the drawing control method includes the steps of: extracting a feature value of the object based on a captured image by imaging the object; determining whether an one object, whose nail is provided to be formed with the nail design, is one of a plurality of the objects different from each other based on process management information and the feature value of the one object extracted, wherein the feature value with respect to each of the plurality of the objects and information on a performed process with respect to the nail of each of the plurality of the objects of the plurality of processes are registered in association with each other in a storing unit as the process management information; acquiring information on a performed process with respect to the nail of the one object, based on a process management information in a case where the one object is determined to be a specific object out of the plurality of the objects; determining a specific process of the plurality of processes to be performed to the nail of the one object based on the acquired information on the performed process; and controlling the drawing unit to perform the specific process.

BRIEF DESCRIPTION OF THE SEVERAL VIEWS OF THE DRAWING

FIG. 4 is a table of exemplary information stored in a process management storing unit.

DETAILED DESCRIPTION OF THE INVENTION

Figure 1:
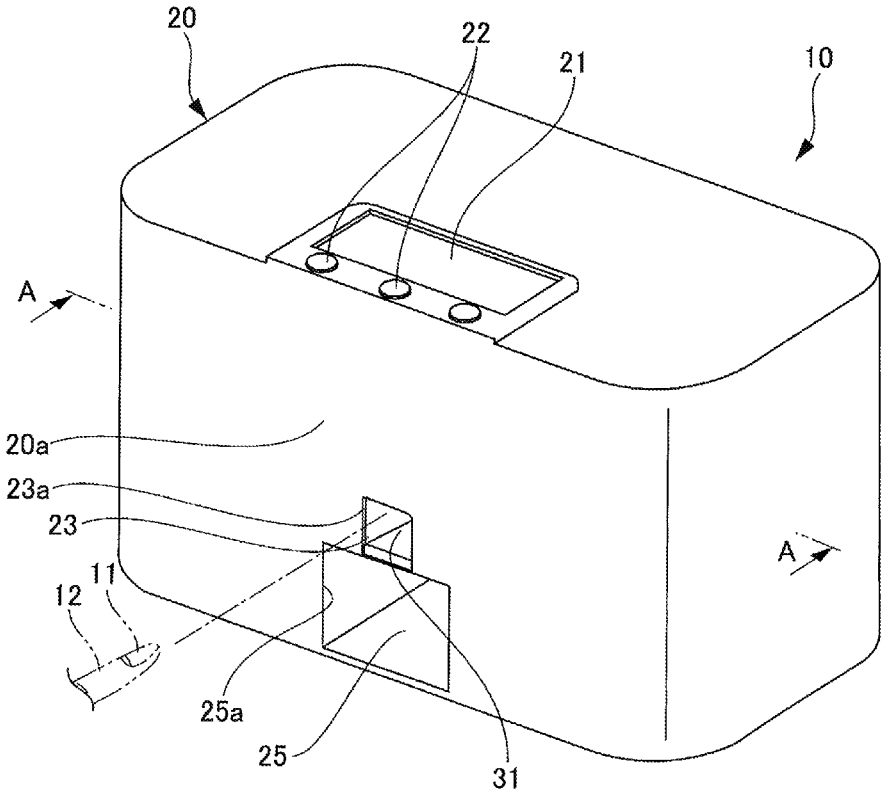
FIG. 1 is a perspective view of an appearance of a drawing apparatus according to an embodiment of the present invention.

A drawing apparatus and a drawing control method thereof according to an embodiment of the present invention will be described in detail below with the drawings illustrated.

Note that, the same elements are denoted with the same reference numerals through the entire descriptions of the embodiment.

According to the embodiment below, the drawing apparatus will be described so as to perform drawing on the nail of a finger being an object to which the drawing is performed. However, the object to which the drawing is performed, according to the embodiment of the present invention is not limited to the nail of the finger, and, for example, the nail of a toe may be the object to which the drawing is performed.

[Entire Configuration of Drawing Apparatus]

The drawing apparatus 10 according to the embodiment of the present invention will be described with reference to FIGS. 1 to 4.

FIG. 1 is a perspective view of an appearance of the drawing apparatus 10.

As illustrated in FIG. 1, the drawing apparatus 10 includes a drawing function and performs a nail design on a nail 11 of a finger 12. The drawing apparatus 10 includes a box-shaped housing 20. A display unit 21 and an operating unit 22 are provided to an upper surface (a top) of the housing 20.

The display unit 21 displays, for example, progress during the drawing and a message to a user.

The operating unit 22 performs, for example, an input operation by the user.

(First Finger Inserting Portion and Second Finger Inserting Portion)

An insertion opening 23*a* of a first finger inserting portion 23 is provided at a lower center of a front portion 20*a* of the housing 20.

The first finger inserting portion 23 is a space into which the finger 12 having the nail 11 being the object to which the drawing is performed is inserted (a finger inserting portion), and is formed with an opening end of a finger retaining case 30 coupled to the insertion opening 23*a*.

Figure 2:
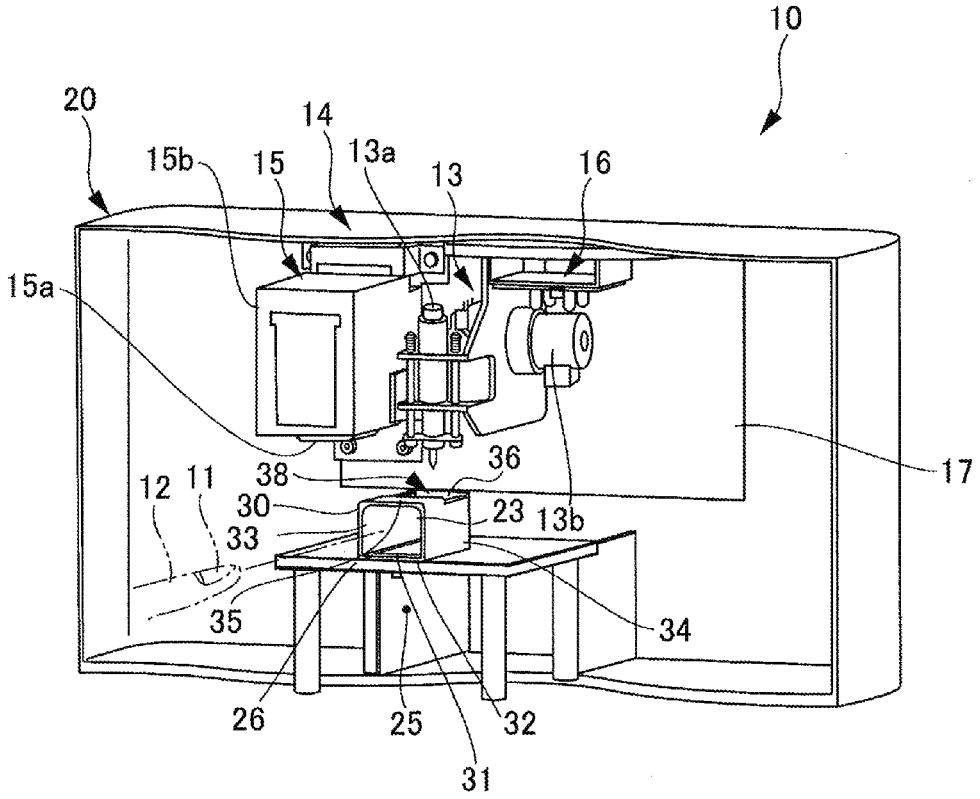
FIG. 2 is a perspective view taken along line A-A of a housing of the drawing apparatus in FIG. 1.

FIG. 2 is a perspective view taken along line A-A of FIG. 1.

As illustrated in FIG. 2, a finger mounting stand 26 is provided to a lower portion inside the housing 20. The finger retaining case 30 is provided to an upper surface of the finger mounting stand 26.

The entire finger retaining case 30 is tubular, and is formed with a lower wall 32, left and right side walls 33 and 34 extending upward in a vertical direction from both left and right end portions of the lower wall 32, an upper wall 35 coupling upper end portions of the left and right side walls 33 and 34, and an inner wall 36 coupling end portions of the left and right side walls 33 and 34 on the inner side in a direction in which the finger 12 is inserted.

An opening 38 is formed between the upper wall 35 and the inner wall 36 so as to expose the nail 11 of the finger 12 that has been inserted, upward in the vertical direction.

A finger retaining portion 31 is provided inside the finger retaining case 30.

The finger retaining portion 31 is a member that inhibits a movement of the finger 12 between the upper wall 35 of the finger retaining case 30 and the finger retaining portion 31. The finger retaining portion 31 is formed with a bag-shaped body that expands and contracts in accordance with supply and discharge of fluid, such as air.

When the air is supplied from a pump not illustrated to the inside, the finger retaining portion 31 expands so as to push up the inside of a first joint of the finger 12. When the air is discharged from the inside, the finger retaining portion 31 contracts so as to release a state where the finger 12 has been pushed up. Note that, detailed descriptions of a mechanism for supplying and discharging the air with respect to the finger retaining portion 31 will be omitted. The mechanism appropriately includes, for example, the pump, an air intake and exhaust line, and a valve provided on the air intake and exhaust line.

An insertion opening 25*a* of a second finger inserting portion 25 is provided on the lower side of the first finger inserting portion 23.

The second finger inserting portion 25 is a space into which the other fingers, except the finger 12, out of a plurality of fingers belonging to one hand, are inserted. The second finger inserting portion 25 is formed from the front portion 20*a* of the housing 20 toward the inner side in the direction in which the finger 12 is inserted, and additionally is a space independent of (disconnected from) an internal space of the housing 20.

(Drawing Unit and Image Capturing Unit)

A fixing plate 17 is provided to an upper portion inside the housing 20 so as to be movable in a width direction and a depth direction of the drawing apparatus 10.

A drawing unit 14 having a pen plotter 13 and an inkjet unit 15, and an image capturing unit 16 are fixed to the fixing plate 17 so as to be arranged in the width direction of the drawing apparatus 10.

Therefore, when the fixing plate 17 moves in the width direction and the depth direction of the drawing apparatus 10, the drawing unit 14 including the pen plotter 13 and the inkjet unit 15, and the image capturing unit 16 move together with the fixing plate 17 in the width direction and the depth direction of the drawing apparatus 10.

Note that, FIG. 2 illustrates a state inside the drawing apparatus 10 when the pen plotter 13 of the drawing unit 14 moves upward in the vertical direction with respect to the opening 38 of the finger retaining case 30.

Here, the pen plotter 13 is a unit that draws, for example, a foundation on a surface of the nail 11, and includes a pen 13*a* that performs the drawing on the nail 11. The pen plotter 13 can ascend and descend in the vertical direction by use of a driving unit 13*b*, such as a stepping motor. Therefore, the pen plotter 13 is movable in the width direction, the depth direction, and the vertical direction of the drawing apparatus 10, together with the movement of the fixing plate 17 described above. Accordingly, after moving right above the opening 38 of the finger retaining case 30, the pen plotter 13 can perform the drawing on the surface of the nail 11 with a penpoint of the pen 13*a* in a state where the pen 13*a* has descended so that the penpoint of the pen 13*a* is in contact with the surface of the nail 11.

The inkjet unit 15 is a unit that prints the design on the surface of the nail 11, for example. The inkjet unit 15 includes an inkjet head 15*a* and an inkjet cartridge 15*b*. The inkjet unit 15 can perform the desirable design on the surface of the nail 11 with the inkjet head 15*a* in a state where the inkjet unit 15 has moved right above the opening 38 of the finger retaining case 30 in accordance with the movement of the fixing plate 17.

The image capturing unit 16 is, for example, a camera, and captures an image of a leading end portion of the finger 12 including the nail 11. Image data of a captured image of the finger 12 including the nail 11, captured by the image capturing unit 16, is used for specification of the finger 12 inserted into the first finger inserting portion 23, to be described later.

[Functional Configuration of Drawing Apparatus]

Figure 3:
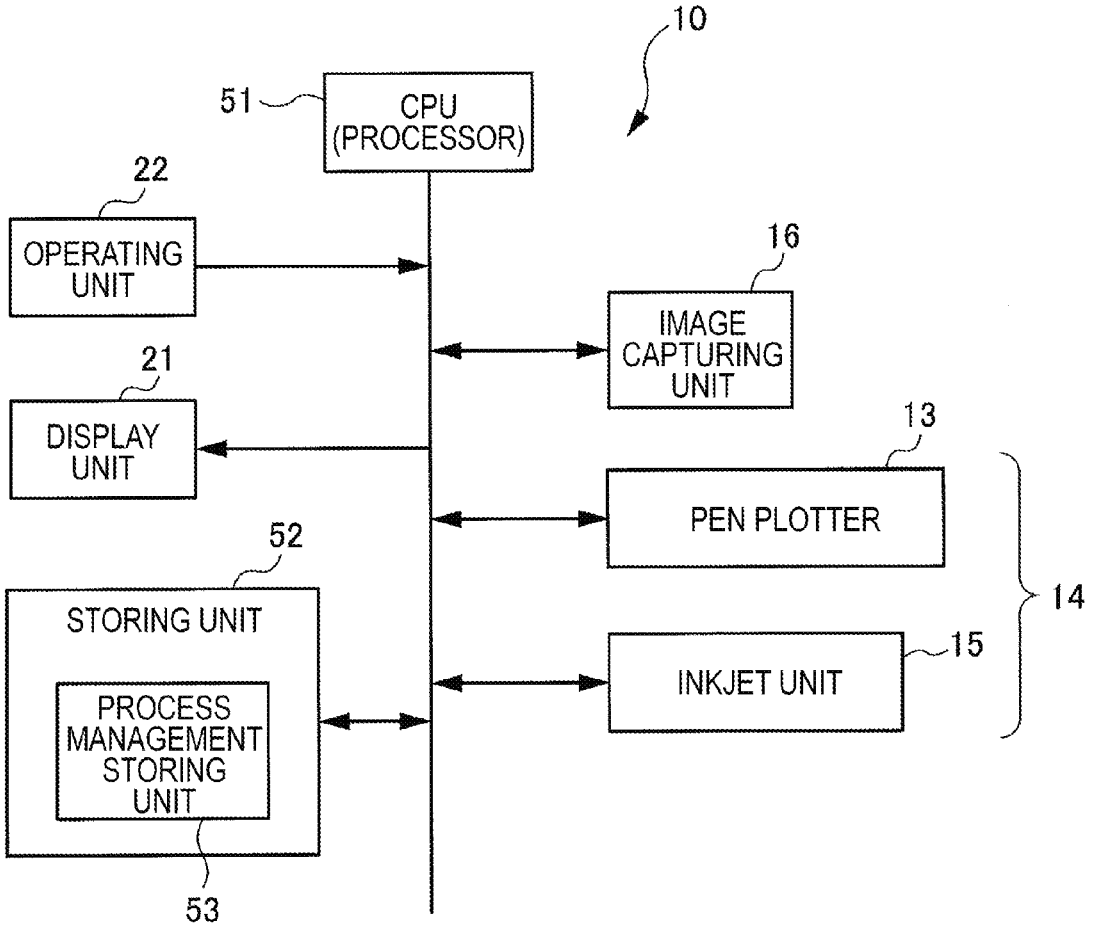
FIG. 3 is a block diagram of a functional configuration of the drawing apparatus.

FIG. 3 is a block diagram of a functional configuration of the drawing apparatus 10.

The drawing apparatus 10 having the configuration described above includes functional units, such as a CPU (processor) 51 and a storing unit 52, other than the pen plotter 13, the inkjet unit 15, the image capturing unit 16, the display unit 21, and the operating unit 22, described above.

The CPU 51 controls operation of each of the functional units, based on an instruction of the user through the operating unit 22, a predetermined control program stored in the storing unit 52, and varieties of information including process management information to be described later.

The CPU 51 extracts information on the nail 11 and a feature point of the finger 12, to be described later, from the image data of the captured image of the finger 12 captured by the image capturing unit 16, and stores the information of the nail 11 and the feature point of the finger 12 into a process management storing unit 53 of the storing unit 52.

Furthermore, the CPU 51 manages progress of each of the processes for forming the design with respect to each finger 12, and stores the progress into the process management storing unit 53 of the storing unit 52.

In addition, the CPU 51 issues an instruction to a driving mechanism of the fixing plate 17 so as to position the pen plotter 13 and the inkjet unit 15 in response to each of the processes for forming the nail design.

The storing unit 52 stores information including, for example, the program for achieving a function of each of the functional units described above, the instruction of the user input through the operating unit 22, the image data of the captured image captured by the image capturing unit 16, and information generated by the CPU 51, necessary to make each of the functional units described above perform the predetermined function.

Here, information necessary to manage the plurality of processes for forming the nail design on the nail 11 is referred to as process management information. A region in which the process management information is stored (registered), in the storing unit 52 is referred to as the process management storing unit 53.

Note that, according to the present embodiment, the storing unit 52 is included inside the drawing apparatus 10. However, the embodiment of the present invention is not limited to this. That is, for example, separately from the drawing apparatus 10, the storing unit 52 may be included in a cloud system provided to the outside. In this case, the drawing apparatus 10 may communicate with the cloud system so as to read and use the process management information of the storing unit 52 in the cloud system.

FIG. 4 is a table of the exemplary process management information stored in the process management storing unit 53.

Here, a case where one specific user uses the drawing apparatus 10 and the nail design is performed on the nails of all the fingers of both bands of the specific user will be described.

Thus, the process management information about each of the ten fingers is stored (registered) in the process management storing unit 53.

However, there is no need to perform the nail design to all the ten fingers. For example, the nail design may be performed to only eight fingers in response to an instruction of the user.

Note that, a case where the one specific user uses the drawing apparatus 10, has been made, but the embodiment of the present invention is not limited to this.

For example, a plurality of users may use the drawing apparatus 10 and the nail design may be performed on the nails of a plurality of fingers of each of the users.

In this case, for example, the process management information about each of the plurality of fingers of each of the users is stored in the process management storing unit 53. Alternatively, the operating unit 22 may input identifying information, such as names and ID numbers of the users who use the drawing apparatus 10. Then, the process management information may be stored in the process management storing unit 53 in association with each of the users who uses the drawing apparatus 10. In this case, when each of the users uses the drawing apparatus 10, the operating unit 22 inputs the identifying information of the corresponding user so that the process management information of the user corresponding to the input identifying information is read and then the process management is performed.

The process management information stored in the process management storing unit 53 will be specifically described.

In FIG. 4, the "identifying number" is a number to be given to each of a plurality of the fingers 12, for convenience, in order to identify each of the plurality of the fingers 12 in the following processing when a new finger 12 is determined to be inserted into the drawing apparatus 10 in a process management procedure to be described later.

For example, "1" to "10" included in the identifying number are allocated so as to correspond to the respective ten fingers of both of the hands.

Note that, the inserting order of the fingers 12 into the drawing apparatus 10 is not determined and is random. Thus, for example, the identifying number is allocated in order in which the user individually inserts the fingers 12 into the drawing apparatus 10. Accordingly, for example, an identifying number of 1 corresponds to the forefinger of the right hand of the specific user, an identifying number of 2 corresponds to the middle finger of the right hand of the specific user, and an identifying number of 3 corresponds to the forefinger of the left hand of the specific user.

The process management information relating to a process that has already been performed to the nail 11 of the corresponding finger 12 is stored (registered) in an item of "performed process", out of the plurality of processes for forming the nail design on the nail.

According to the present embodiment, the nail design is completed through three processes including a foundation forming process of coating ink for a foundation and forming the foundation, a design drawing forming process of coating various types of ink for a design drawing, drawing and forming the design drawing, and a topcoat forming process of coating ink for a topcoat and forming the topcoat.

In this case, any of the three processes or information indicating that any of the processes has not been performed, is stored in the item of "performed process".

The captured image of the finger 12 including the nail 11, captured by the image capturing unit 16 after the performance of each of the processes, is stored (registered) in an item of "image".

The captured image of the finger 12 including the nail 11 includes, for example, one captured image captured by the image capturing unit 16 after the performance of the foundation forming process of forming the foundation on the nail 11. Alternatively, the captured image of the finger 12 includes a plurality of captured images including the captured image captured by the image capturing unit 16 after the performance of each of the processes. Alternatively, the captured image of the finger 12 including the nail 11, may include the latest one captured image captured by the image capturing unit 16 after the performance of each of the processes between the foundation forming process and the topcoat forming process.

Information on the nail 11, necessary to form the design on the nail 11 of the finger 12, is stored (registered) in an item of "nail information".

The information on the nail 11 includes, for example, a value of the curvature of a curved shape of the nail 11 and information on an outline shape of the nail 11 extracted by the CPU 51 from the captured image of the finger 12 including the nail 11, described above.

The value of the curvature of the curved shape of the nail 11 and the information on the outline shape of the nail 11 are used when the drawing unit 14 performs the drawing on the nail 11.

When a SIFT method to be described later is applied in order to extract a feature value, a feature point of the finger 12 and the feature value corresponding to the feature point, extracted by the CPU 51 from the captured image of the finger 12, are stored (registered) in an item of "feature value".

When another method is applied for the extraction of the feature value, the feature value is registered in the item of "feature value".

Image matching is performed between a captured image stored in the process management storing unit 53 and the captured image of the finger 12 including the nail 11, inserted into the first finger inserting portion 23, so as to determine whether the finger 12 that has been currently inserted into the first finger inserting portion 23 is a registered finger. When the registration has already been made, the above feature point and feature value are used in order to determine which identifying number the finger 12 corresponds to.

A method of performing the above image matching will be described below.

(Method of Performing Image Matching)

There is a plurality of methods to be described below as the method of performing the image matching.

The image matching may use any one of the plurality of methods or a combination of the plurality of methods.

<SIFT (Scale-Invariant Feature Transform)>

A SIFT method performs image matching between two images, based on a feature point and a local descriptor (a feature value).

According to the present embodiment, every time the finger 12 is inserted into the first finger inserting portion 23 and the image capturing unit 16 captures an image of the leading end portion of the finger 12 including the nail 11, the CPU 51 determines (extracts) the feature point, such as the shape of wrinkles or streaks of skin, a specific shape, or a specific color, in the captured image of the finger 12 including the nail 11, captured by the image capturing unit 16. In addition, the CPU 51 defines the local descriptor with respect to a local region around the feature point.

For example, the CPU 51 determines N key points (the feature points) and calculates a 128-dimensional SIFT feature value with respect to each of the key points, in the captured image of the finger 12 including the nail 11. As illustrated in FIG. 4, the feature points and the feature values extracted in this manner are stored (registered) in the item of "feature value" in the process management storing unit 53.

Note that, examples of a method of searching the feature points include various methods, such as Harris, DoG, and MSER, and any of the methods may be used for the method of searching the feature points. Examples of the definition of the descriptor include various methods, such as GLOH and SURF, and any of the methods may be used for the definition of the descriptor.

Every time the finger 12 is inserted into the first finger inserting portion 23, the feature values for the feature points extracted from the captured image of each finger, are compared in order to determine whether the finger 12 is a finger already registered in the process management storing unit 53.

According to the present embodiment, Euclidean distances are acquired between a finger that has been currently inserted into the first finger inserting portion 23 (hereinafter, referred to as a current finger) and fingers having identifying numbers of 1 to 10 already registered in the process management storing unit 53 (hereinafter, referred to as already registered fingers having identifying numbers of 1 to 10) so that the above comparison of the feature values for the feature points is made.

Specifically, Euclidean distances between a feature value corresponding to one feature point in the current finger and feature values corresponding to N feature points in the already registered finger having an identifying number of 1, are first calculated. A value indicating the shortest distance, out of the N Euclidean distances calculated in this manner, is set to be a score with respect to the one feature point in the current finger.

The above score calculation is performed to all the remaining (N−1) feature points in the current finger. The sum of the scores with respect to the N feature points is set to be similarity between the already registered finger having an identifying number of 1 and the current finger.

The above similarity calculation with respect to the current finger is performed with the respective already registered fingers having identifying number of 2 to 10.

Then, when a piece of similarity out of the ten pieces of similarity calculated in this manner is highest with respect to a specific finger corresponding to a specific identifying number, out of the already registered fingers having the plurality of identifying numbers, and additionally when the highest similarity is a value higher than a predetermined reference value, the specific finger corresponding to the specific identifying number is determined to be a finger corresponding to the current finger.

Meanwhile, when the highest similarity is a value lower than the predetermined reference value, no finger having the already registered identifying number, corresponding to the current finger, is determined to be present. That is, the current finger is not any of the already registered fingers. The finger that has been currently inserted into the first finger inserting portion 23 is determined to be a new finger that has been first inserted into the first finger inserting portion 23.

<LBP (Local Binary Pattern)>

An LBP method will be given as another method except the SIFT method.

The LBP method compares a pixel value of an attention point and pixel values of eight points adjacent to the attention point, in size, so as to binarize the pixel values of the adjacent eight points and generate an LBP including an eight-digit binary number. Then, an LBP histogram expresses a captured image being an object to which processing is performed, so that feature expression of the captured image, namely, a feature value is extracted.

Note that, various methods of extracting a feature value, such as center-symmetric LBP (CS-LBP), based on the LBP method, may be used.

According to the present embodiment, every time the finger 12 is inserted into the first finger inserting portion 23 and the image capturing unit 16 captures the image of the leading end portion of the finger 12 including the nail 11, the feature value (a histogram) in the captured image of the captured finger 12 including the nail 11 is extracted and is compared to the feature value (a histogram) of the already registered finger having an identifying number of 1.

For example, any method of the Euclidean distance, an intersection method, a correlation method, a chi-squared test, and the Bhattacharyya distance, may be used in order to compare the feature values.

A result acquired by the comparison in this manner is a value indicating the similarity between the current finger and the already registered finger having an identifying number of 1. Note that, the Euclidean distance indicates zero and the intersection method indicates 1.0 between perfectly identical histograms.

Similarly, the pieces of similarity between the current finger and the already registered fingers having identifying numbers of 2 to 10 are individually calculated.

Then, a piece of similarity out of the 10 pieces of similarity calculated in this manner, with respect to a specific finger corresponding to a specific identifying number, out of the already registered fingers having the plurality of identifying numbers, is closest to a predetermined value set in accordance with a method of comparing the feature values, and additionally when the similarity closest to the predetermined value is a value in a predetermined range (a threshold value), the specific finger corresponding to the specific identifying number is determined to be a finger corresponding to the current finger.

Meanwhile, when the similarity closest to the predetermined value is a value out of the predetermined range (the threshold value), the current finger is determined not to be any of the fingers having already registered identifying numbers. That is, the current finger is determined to be a new finger that has been first inserted into the first finger inserting portion 23.

[Procedure of Process Management of Printing]

The process management procedure of a process of forming the design on the nail 11 will be described with reference to FIG. 5.

Figure 5:
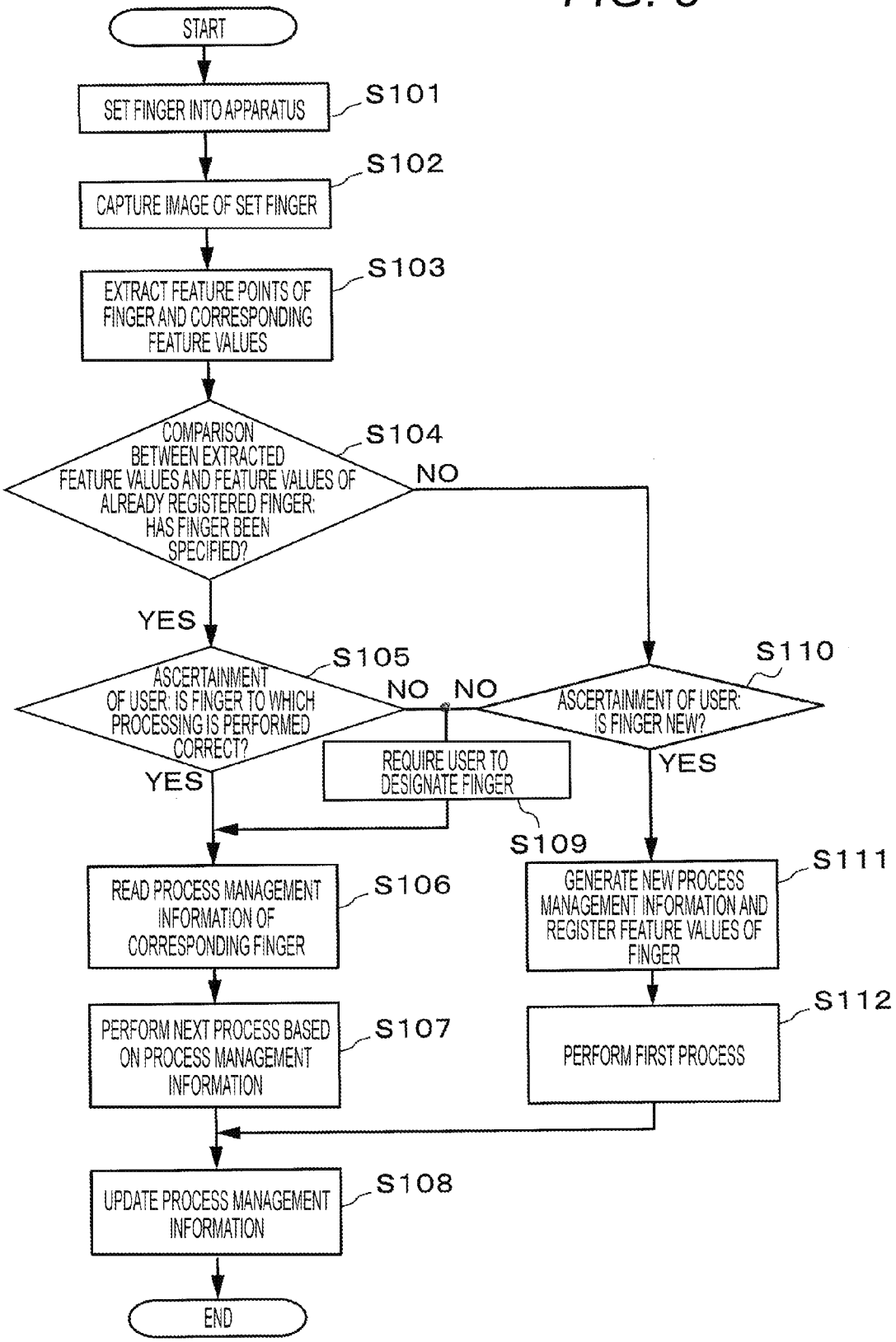
FIG. 5 is a flow chart of a procedure of process management with respect to a process of forming a design on a nail.

FIG. 5 is a flow chart of the procedure of process management with respect to the process of forming the design on the nail 11.

Here, the procedure of the process management will be described in a case where the SIFT method is used for image matching between the captured image of the finger 12 and the captured image stored in the process management storing unit 53.

First, when the finger 12 is inserted into the first finger inserting portion 23 of the drawing apparatus 10 at step S101, the image capturing unit 16 captures the image of the inserted finger 12 together with the nail 11 at step S102. The process management storing unit 53 stores the captured image of the captured finger 12 including the nail 11.

Next, at step S103, the feature points of the finger 12 and the feature values corresponding to the respective feature points are extracted from the captured image of the finger 12 including the nail 11, captured by the image capturing unit 16.

Here, only a predetermined number N of the feature points are extracted by an image analysis with respect to the captured image of the finger 12 including the nail 11, captured by the image capturing unit 16.

Here, one or a plurality of the feature points may be extracted, for example, based on wrinkles or streaks of skin of the finger 12, wrinkles of a surface of the nail 11, a state of the surface including flaws and an uneven shape, the outer shape and an edge shape of the nail 11. Then, the feature values for the extracted feature points may be extracted.

After the drawing is performed on the nail 11, the feature points based on, for example, a characteristic shape of a pattern of the nail design formed on the nail 11 or a portion of characteristic coloring of the pattern may be extracted and then the feature values for the extracted feature points may be extracted.

Note that, the CPU 51 performs the process.

Next, at step S104, the feature values extracted from the captured image of the finger 12 including the nail 11 are compared to the respective feature values of the already registered fingers 12 having identifying numbers of 1 to 10.

Then, it is determined whether a specific finger 12 corresponding to a specific identifying number, having similarity with respect to the feature values of the current finger 12, higher than the predetermined reference value, is present in the plurality of already registered fingers 12 corresponding to the plurality of identifying numbers.

The CPU 51 performs the process.

When it is determined that the specific finger 12 corresponding to the specific identifying number, having the similarity with respect to the feature values of the current finger, higher than the reference value, is present, at step S104, the display unit 21 displays information relating to the specific finger 12 corresponding to the specific identifying number and requires the user to ascertain whether a determination result at step S104 is correct, at step S105.

When the user ascertains that the determination result at step S104 is correct, through input to the operating unit 22 by the user at step S105, the CPU 51 reads the process management information (refer to FIG. 4) corresponding to the corresponding finger 12, from the process management storing unit 53, at step S106.

On the other hand, when the user ascertains that the determination result at step S104 is incorrect, through the input to the operating unit 22 by the user at step S105, the user is required to designate the type of a correct finger 12 at step S109.

Then, when the user designates the type of the correct finger 12 at step S109, the CPU 51 reads the process management information (refer to FIG. 4) corresponding to the type of the finger 12 designated by the user, from the process management storing unit 53 at step S106.

After that, a process that has not performed to the nail 11 of the corresponding finger 12, to be performed next, is performed to the nail 11, out of the foundation forming process, the design drawing forming process, and the topcoat forming process in the process of forming the nail design, based on the process management information read at step S106, at step S107.

More specifically, information including a process already performed with respect to the nail 11 of the corresponding finger 12 is acquired, based on a record of the performed process of the process management information illustrated in FIG. 4. Then, a process to be performed next to the nail 11 of the corresponding finger 12 is determined. The next process corresponding to any of the foundation forming process, the design drawing forming process, and the topcoat forming process, is performed.

Next, when the performance of the next process is completed at step S107, the process management information corresponding to the corresponding finger 12, for example, "performed process", is updated at step S108 and the processing is completed.

In addition, the image of the finger 12 including the nail 11 to which the next process has been performed at step S107, may be captured, and an update or addition may be made to the captured image at step S108.

Furthermore, the feature values in a region of the nail 11 may be acquired for the feature points, such as the characteristic shape of the pattern of the nail design drawn and formed on the nail 11 or the portion of the characteristic coloring of the pattern, based on an image of the nail 11 in the captured image of the finger 12 including the nail 11 to which the next process has been performed and the drawing has been performed at step S107. Then, the feature values of the corresponding process management information may be updated or the feature values may be additionally registered.

Meanwhile, when it is determined that no finger 12 having the already registered identifying number, having feature values corresponding to the feature values of the current finger, is present, at step S104, the finger 12 that has been inserted into the first finger inserting portion 23 is determined to be an unregistered finger 12 (a new finger 12) that has not been stored (registered) in the process management storing unit 53.

The display unit 21 displays the effect that the unregistered finger 12 has been inserted into the drawing apparatus 10, and requires the user to ascertain whether the finger that has been inserted into the drawing apparatus 10 is an unregistered finger, at step S110.

When the user ascertains that the insertion of the unregistered finger 12 into the drawing apparatus 10 is correct, through input to the operating unit 22 by the user, at step S110, a new identifying number is set for the finger 12 that has been inserted in the first finger inserting portion 23 at that time, at step S111.

The process management storing unit 53 generates process management information of the new identifying number corresponding to the corresponding finger 12, and stores (registers) the feature values extracted from the captured image of the finger 12, in association with new printing management information.

A first process, namely, the foundation forming process is performed to the finger 12 that has been inserted into the first finger inserting portion 23, at step S112.

Next, step S108 described above is performed and then a series of the processes is completed.

On the other hand, when the user ascertains that the finger 12 that has been inserted into the drawing apparatus 10 is not the unregistered finger 12, at step S110, the processing proceeds to step S109.

The user designates the type of the correct finger 12 at step S109.

The processing proceeds to step S106 again, and the CPU 51 reads the process management information corresponding to the finger 12 designated by the user, from the process management storing unit 53.

Sequentially, step S107 and step S108 described above are performed and then the series of the processes is completed.

The series of the processes described above is performed every time one finger 12 is inserted into the first finger inserting portion 23.

Therefore, the procedure including the insertion of any of the ten fingers into the first finger inserting portion 23, the performance of any of the three processes including the foundation forming process, the design drawing forming process, and the topcoat forming process, to the nail 11 of the corresponding finger 12, and the movement of the finger 12 out of the first finger inserting portion 23 when the respective processes are completed, is repeated.

When the procedure is repeated 30 times, the performance of the nail design to the ten fingers of both of the hands of the user is completed.

During the performance of the series of processes, there is no need for the user oneself to manage which process has been completed in the process of forming the nail design for each of the respective fingers, and the drawing apparatus 10 performs the process management.

Accordingly, a process to be performed to the nail of each of the fingers is correctly performed so as not to fail to form the nail design. Thus, the formation of the nail design can be certainly performed.

Furthermore, there is no need for the user to insert each of the fingers 12 into the drawing apparatus 10 in previously determined order. An arbitrary finger may be inserted into the drawing apparatus 10 in arbitrary order.

The processing can be performed to the nail 11 of another finger 12 (any of the foundation forming process, the design drawing forming process, and the topcoat forming process) during drying of the ink on the nail 11 in a case where any of the foundation forming process, the design drawing forming process, and the topcoat forming process has been performed to the nail 11 of one finger 12.

Accordingly, time necessary to complete the processing to all the plurality of fingers 12, can shorten.

Therefore, the desired nail design can be promptly, certainly formed without the user burdened with the management.

The preferred embodiment of the present invention has been described above. The present invention is not limited to the embodiment described above. Various modifications and alterations may be made without departing from the scope of the spirit of the present invention described in the claims.

In addition, a case where the nail design is formed on the nail 11 of the finger has been exemplified in the specific embodiment. The embodiment of the present invention is not limited to this. The drawing apparatus may be used to form the nail design on the nail of a toe, for example.

What is claimed is:

1. A drawing apparatus comprising:

a drawing unit configured to form a nail design on a nail of an object by performing a plurality of processes, the object being a finger or a toe having the nail; and a processor configured to extract a feature value of the object based on a captured image of the object and configured to control the drawing unit, wherein the feature value with respect to each of a plurality of the objects different from each other and information on a performed process with respect to the nail of each of the plurality of the objects are registered in association with each other in a storing unit as process management information, and wherein the processor:

determines whether an one object, whose nail is provided to be formed with the nail design, is one of the plurality of the objects based on the process management information and a feature value of the one object;

acquires information on a performed process with respect to the nail of the one object based on the process management information in a case where the processor determines that the one object is a specific object of the plurality of the objects;

determines a specific process of the plurality of processes to be performed with respect to the nail of the one object based on the acquired information on the performed process; and controls the drawing unit to perform the specific process.

2. The drawing apparatus according to claim 1, wherein the processor determines whether the one object is any of the plurality of the objects based on comparison between the feature value with respect to the one object and the feature value of each of the plurality of the objects.

3. The drawing apparatus according to claim 2, wherein the processor registers the feature value with respect to the one object in the process management information, and controls the drawing unit to perform a first process in the plurality of processes with respect to the nail of the one object when the processor determines that the one object is not any of the plurality of the objects.

4. The drawing apparatus according to claim 1, wherein the processor extracts, as at least a part of the feature value, a first feature value for at least one feature point in a first image excluding a region of the nail in the captured image.

5. The drawing apparatus according to claim 4, wherein the processor extracts, as at least a part of the feature value, a second feature value for at least one feature point in a second image including the region of the nail in the captured image.

6. The drawing apparatus according to claim 5, wherein the processor extracts the second feature value based on at least any of a state of a surface of the nail and an outer shape of the nail.

7. The drawing apparatus according to claim 5, wherein the processor extracts the second feature value based on the second image including the region of the nail in the one object in the captured image including the image of the one object captured after the drawing unit performs the specific process to the nail of the one object and coats the ink on the nail of the one object, and the processor updates the feature value corresponding to the specific object registered in the process management information to a value including the second feature value after the drawing unit performs the specific process to the nail of the one object.

8. The drawing apparatus according to claim 1, wherein, after the drawing unit performs the specific process to the nail of the one object, the processor updates the process management information to a state which the specific process has been performed for the nail of the specific object.

9. The drawing apparatus according to claim 1, wherein the processor uses at least any of a SIFT method and an LBP method with respect to the captured image so as to extract the feature value.

10. The drawing apparatus according to claim 1, wherein the processor configured to extract nail information including information relating to an outer shape of the nail and a curved shape of the nail in a width direction of the nail, the process management information includes the nail information with respect to the nail of each of the plurality of the objects, in association with the feature value extracted with respect to each of the plurality of the objects, and the processor controls the drawing unit, based on the nail information included in the process management information.

11. A drawing control method of a drawing apparatus including a drawing unit configured to form a nail design on the nail of an object by performing a plurality of processes, the object being a finger or a toe having the nail, the drawing control method including the steps of:

extracting a feature value of the object based on a captured image by imaging the object;

determining whether an one object, whose nail is provided to be formed with the nail design, is one of a plurality of the objects different from each other based on process management information and the feature value of the one object extracted, wherein the feature value with respect to each of the plurality of the objects and information on a performed process with respect to the nail of each of the plurality of the objects of the plurality of processes are registered in association with each other in a storing unit as the process management information;

acquiring information on a performed process with respect to the nail of the one object based on the process management information in a case where the one object is determined to be a specific object out of the plurality of the objects;

determining a specific process of the plurality of processes to be performed to the nail of the one object based on the acquired information on the performed process; and controlling the drawing unit to perform the specific process.

12. The drawing control method of the drawing apparatus according to claim 11, wherein the step of determining whether the one object is any of the plurality of the objects, includes the step of determining whether the one object is any of the plurality of the objects based on comparison between the feature value extracted by the step of extracting the feature value with respect to the one object and the feature value of each of the plurality of the objects.

13. The drawing control method of the drawing apparatus according to claim 12, further including the step of:

registering the feature value extracted by the step of extracting the feature value with respect to the one object in the process management information, and controlling the drawing unit to perform a first process in the plurality of processes with respect to the nail of the one object when the one object is determined not to be any of the plurality of the objects at the step of determining whether the one object is any of the plurality of the objects.

14. The drawing control method of the drawing apparatus according to claim 11, wherein the step of extracting the feature value includes the step of extracting, as at least a part of the feature value, a first feature value for at least one feature point in a first image excluding a region of the nail in the captured image.

15. The drawing control method of the drawing apparatus according to claim 14, wherein the step of extracting the feature value includes the step of extracting, as at least a part of the feature value, a second feature value for at least one feature point in a second image including the region of the nail in the captured image.

16. The drawing control method of the drawing apparatus according to claim 15, wherein the step of extracting the feature value includes the step of extracting the second feature value based on at least any of a state of a surface of the nail and an outer shape of the nail.

17. The drawing control method of the drawing apparatus according to claim 15, further including the step of:

updating after the specific process is performed to the nail of the one object, the feature value corresponding to the specific object registered in the process management information to a value including the second feature value extracted by the step of extracting the feature value based on the second image, wherein the step of extracting the feature value includes the step of extracting the second feature value based on the second image including the region of the nail in the one object in the captured image including the image of the one object captured after the drawing unit performs the specific process to the nail of the one object and coats the ink on the nail of the one object.

18. The drawing control method of the drawing apparatus according to claim 11, further including the step of:

updating, after the specific process is performed to the nail of the one object, the process management information to a state which the specific process has been performed for the nail of the specific object.

19. The drawing control method of the drawing apparatus according to claim 11, further including the steps of:

extracting nail information including information relating to an outer shape of the nail and a curved shape of the nail in a width direction of the nail; and controlling the drawing unit based on the nail information included in the process management information, wherein the process management information includes the nail information extracted by the step of extracting the nail information with respect to the nail of each of the plurality of the objects in association with the feature value extracted with respect to each of the plurality of the objects.

* * * * *